US008800722B2

(12) United States Patent
Kodera

(10) Patent No.: US 8,800,722 B2
(45) Date of Patent: Aug. 12, 2014

(54) ELEVATOR CONTROLLER

(75) Inventor: Yuichi Kodera, Nagoya (JP)

(73) Assignee: Mitsubishi Electric Corporation, Tokyo (JP)

( * ) Notice: Subject to any disclaimer, the term of this patent is extended or adjusted under 35 U.S.C. 154(b) by 537 days.

(21) Appl. No.: 13/203,445

(22) PCT Filed: Apr. 15, 2009

(86) PCT No.: PCT/JP2009/057587

§ 371 (c)(1),
(2), (4) Date: Aug. 25, 2011

(87) PCT Pub. No.: WO2010/119525

PCT Pub. Date: Oct. 21, 2010

(65) Prior Publication Data

US 2011/0303495 A1 Dec. 15, 2011

(51) Int. Cl.
*B66B 1/20* (2006.01)

(52) U.S. Cl.
USPC ..... 187/384; 187/388; 187/278

(58) Field of Classification Search
CPC ..... B66B 1/00; B66B 1/2408; B66B 1/36; B66B 3/002; B66B 5/0018; B66B 5/0031; B66B 5/021; B66B 5/024; B66B 5/027
USPC ..... 187/247, 278, 313, 380–389, 391–393, 187/396
See application file for complete search history.

(56) References Cited

U.S. PATENT DOCUMENTS 4,157,133 A * 6/1979 Corcoran et al. ..... 187/384
7,588,126 B2 * 9/2009 Siikonen et al. ..... 187/384
7,926,620 B2 * 4/2011 Amano ..... 187/278
8,230,980 B2 * 7/2012 Mason ..... 187/388
8,616,339 B2 * 12/2013 Endo ..... 187/384
2012/0267202 A1 * 10/2012 Siikonen ..... 187/384

FOREIGN PATENT DOCUMENTS

| | | |
|---|---|---|
| JP | 50 132640 | 10/1975 |
| JP | 56 37969 | 4/1981 |
| JP | 6 255929 | 9/1994 |
| JP | 8 337370 | 12/1996 |
| JP | 2002 68629 | 3/2002 |

OTHER PUBLICATIONS

Office Action issued Feb. 19, 2013 in Korean Patent Application No. 10-2011-7019588 (with partial English translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator controller which enables a stop to be made at the nearest floor in the event of a disaster and can prevent users from being shut up in an emergency landing entrance floor. The elevator controller includes an operation mode controller, a door open/close controller which causes the elevator to open the elevator door at the nearest emergency landing entrance floor for a given time when the operation mode controller has returned an operation mode from an emergency operation mode to a normal operation mode, and an informing controller which causes an informing device, which is provided in a hall of an emergency landing entrance floor for which the door open/close controller causes the door to be opened for a given time or provided in the car, to provide information to the effect that the elevator can be used when the operation mode-controller has returned the operation mode from the emergency operation mode to the normal operation mode.

4 Claims, 5 Drawing Sheets

(56) References Cited

OTHER PUBLICATIONS

"Standard for Earthquake Emergency Return Operation" JEAS-416 (S11-7), Elevator World, Apr. 2001, pp. 26-29.
International Search Report Issued May 19, 2009 in PCT/JP09/057587 filed Oct. 15, 2011.
Japanese Office Action issued Apr. 23, 2013 in Patent Application No. 2011-509125 with Partial English Translation.
Korean Office Action issued Sep. 25, 2012, in Korea Patent Application No. 10-2011-7019588 (with partial English Translation).
English translation of the International Preliminary Report on Patentability issued Nov. 24, 2011, in PCT/JP2009/057587.
English translation of the Written Opinion of the International Searching Authority issued May 19, 2009, in PCT/JP2009/057587.
Combined Chinese Office Action and Search Report issued Apr. 26, 2013, in Chinese Patent Application No. 200980158687.9 with Partial English translation and with English translation of category of cited documents.

* cited by examiner

ELEVATOR CONTROLLER

TECHNICAL FIELD

The present invention relates to an elevator controller.

BACKGROUND ART

In a stop-at-nearest-floor operation, for example, an earthquake emergency return operation of a conventional elevator, as soon as a seismic sensor senses an earthquake, the car stops at the nearest floor and causes the users to get off. After that, until the operation returns to a normal operation, the doors are kept closed and the elevator is at a standstill to prevent the users from getting on the car.

Inspections by maintenance personnel is necessary for returning to a normal operation. However, for example, as described in Japan Elevator Association Standard JEAS-416, when only a small-scale-earthquake detecting device which detects small-scale earthquakes has operated, in some cases, it is determined that this is an earthquake of such a scale as might pose no problem even if an elevator is operated after the finish of the earthquake and the elevator is returned to a normal operation after automatically resetting a seismic sensor.

In this connection, in some cases, a floor at which an elevator is at a standstill becomes an emergency landing entrance floor which is not served usually. This emergency landing entrance floor is not provided with hall buttons for calling cars. For this reason, even when the operation of the elevator returns to a normal operation, the users cannot use the elevator from the emergency landing entrance floor at which they got off the car. That is, it is necessary for the users to move by stairs or the like to other floors at which the elevator can be used. In contrast to this, wheelchair users cannot use stairs and are shut up in the emergency landing entrance floor.

Therefore, as a solution to the problem that when a car comes to a standstill in an emergency landing entrance floor due to a stop-at-nearest-floor operation, wheelchair users are shut up in a hall until they are rescued from the outside, there have been proposed methods which are such that there are provided an evacuation floor for physically-handicapped people and a general evacuation floor, and these floors are properly used depending on the existence or nonexistence of physically-handicapped people, whereby evacuation and guidance are positively carried out (refer to Patent Literature 1, for example).

CITATION LIST

Patent Literature

Patent Literature 1: Japanese Patent Laid-Open No. 8-337370

SUMMARY OF INVENTION

Technical Problem

However, in the elevator controller described in Patent Literature 1, each evacuation floor is determined beforehand and it is necessary to cause a car to run to the floor. For this reason, this elevator controller has posed the problem that it is impossible to make a stop at the nearest floor in the event of a disaster.

The present invention was made to solve the problem described above, and the object of the invention is to provide an elevator controller which enables a stop to be made at the nearest floor in the event of a disaster and can prevent users from becoming shut up in an emergency landing entrance floor.

Means for Solving the Problems

A elevator controller of the present invention includes an operation mode controller which, upon detection of a disaster by a disaster detection device, switches an operation mode of an elevator from a normal operation mode to an emergency operation mode which involves evacuating a user in a car of the elevator by stopping the car at the nearest emergency landing entrance floor other than service floors of the normal operation mode and, upon reset of the disaster detection device, returns the operation mode to the normal operation mode, a door open/close controller which causes the elevator to open the elevator door at the nearest emergency landing entrance floor for a given time when the operation mode controller has returned the operation mode from the emergency operation mode to the normal operation mode, and an informing controller which causes an informing device, which is provided in a hall of an emergency landing entrance floor for which the door open/close controller causes the door to be opened for a given time or provided in the car, to provide information to the effect that the elevator can be used when the operation mode controller has returned the operation mode from the emergency operation mode to the normal operation mode.

Advantageous Effects of Invention

According to the present invention, it is possible to makes a stop at the nearest floor in the event of a disaster and to prevent users from becoming shut up in an emergency landing entrance floor.

DESCRIPTION OF EMBODIMENT

Figure 1:
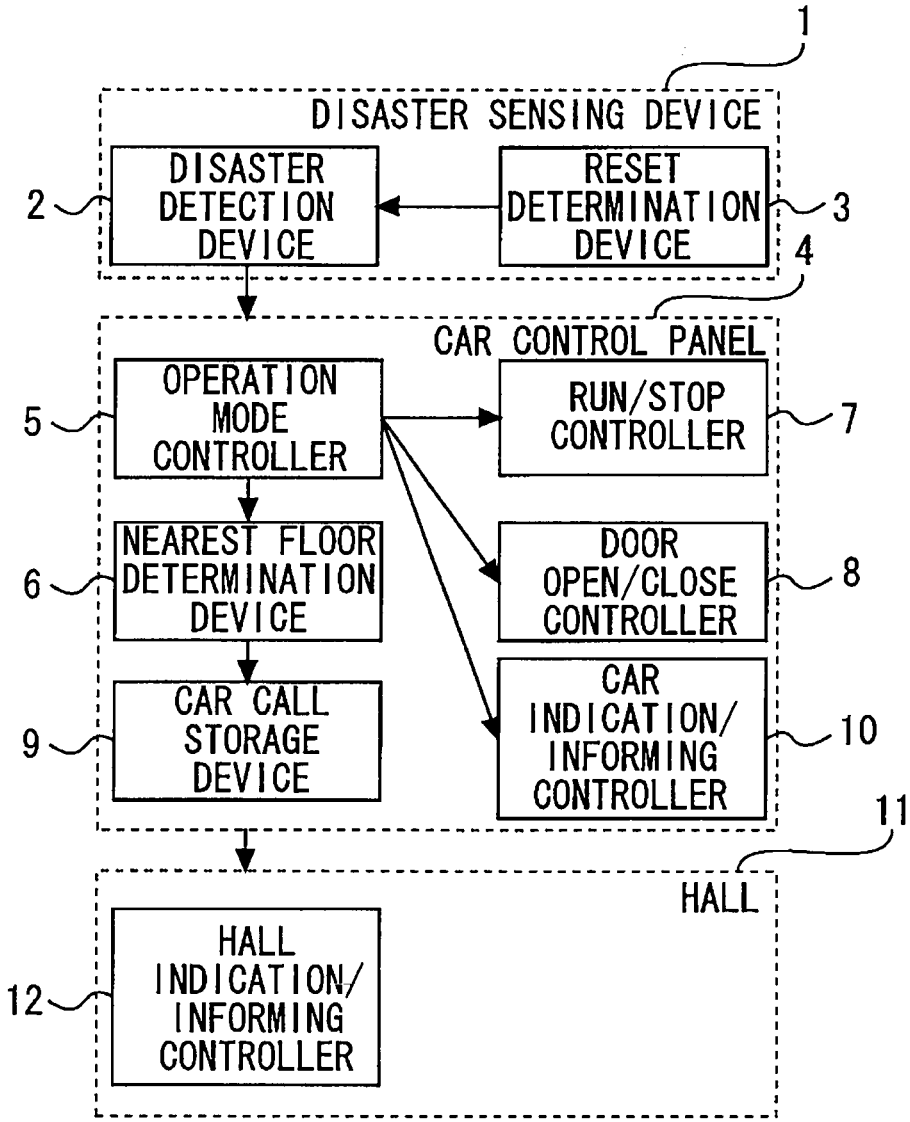
FIG. 1 is a block diagram showing the configuration of an elevator controller in Embodiment 1 of the present invention.

An embodiment of the present invention will be described with reference to the accompanying drawings. In the drawings, like reference numerals refer to like or corresponding parts and overlaps of description of these parts are appropriately simplified or omitted.

Embodiment 1

FIG. 1 is a block diagram showing the configuration of an elevator controller in Embodiment 1 of the present invention.

In FIG. 1, reference numeral 1 denotes a disaster sensing device. This disaster sensing device 1 is provided in a building. This disaster sensing device 1 is provided with a disaster detection device 2 and a reset determination device 3. The disaster detection device 2 has the function of detecting disasters, such as earthquakes and fires in the building. The reset determination device 3 has the function of making a reset determination of disasters detected by the disaster detection device 2.

Reference numeral 4 denotes a car control panel. This car control panel 4 has the function of controlling the operation of a car installed in the building. By the control of this car control panel 4, the car runs through floors of the building. Specifically, the car control panel 4 is provided with an operation mode controller 5, a nearest floor determination device 6, a run/stop controller 7, a door open/close controller 8, a car call storage device 9, and a car indication/informing controller 10.

The operation mode controller 5 has the function of performing the control of switching an operation mode of the elevator to a normal operation mode, an emergency operation mode or the like according to the situation. In this connection, the emergency operation mode is the operation mode which is such that when the disaster detection device 2 has detected a disaster, the car of the elevator in question is caused to stop at the nearest emergency landing entrance floor regardless of whether or not the floor is a service floor of the normal operation mode. As a result of this, it is possible to evacuate users in the car to an emergency landing entrance floor in the event of a disaster.

The nearest floor determination device 6 has the function of making a determination as to which floor is the nearest floor. The run/stop controller 7 has the function of controlling the run and stop of the car. The door open/close controller 8 has the function of controlling the opening and closing of the doors of the elevator. The car call storage device 9 has the function of storing car calls of the elevator. The car indication/informing controller 10 has the function of controlling the indication and informing to users in the car.

Reference numeral 11 denotes an elevator hall. This hall 11 is provided with a hall indication/informing controller 12. This hall indication/informing controller 12 has the function of controlling the indication and informing to users in the hall.

In the elevator controller of this configuration, when the disaster sensing device 1 has sensed a disaster, the disaster detection device 2 transmits disaster detection information to the car control panel 4. The operation mode controller 5 which has received this disaster detection information switches the operation mode of the elevator from the normal operation mode to the emergency operation mode, and transmits operation mode switching information to the nearest floor determination device 6, the run/stop controller 7, the door open/close controller 8, and the car indication/informing controller 10.

The nearest floor determination device 6 which has received the switching information determines the present nearest floor and transmits the nearest floor determination information to the car call storage device 9. The car call storage device 9 which has received this nearest floor determination information cancels car calls which have been registered, and stores the car calls.

The run/stop controller 7 which has received the switching information controls whether or not the car is caused to stop at the nearest floor and at which floor the car is caused to stop when the car is caused to stop. Furthermore, after the car stops at the floor at which the car is caused to stop by the operation of the run/stop controller 7, the door open/close controller 8 which has received the switching information causes the doors of the elevator to be opened and closed. And the car indication/informing controller 10 causes an indication/informing device in the car to indicate appropriate guidance to users and inform users of appropriate guidance.

In this connection, when in the reset determination device 3, automatic reset conditions for disaster detection hold, the disaster detection information transmitted from the disaster detection device 2 to the car control panel 4 is cancelled. As a result of this, the operation mode controller 5 causes the operation mode of the elevator to be returned from the emergency operation mode to the normal operation mode.

At this time, in the case where the car is at a standstill on an emergency landing entrance floor, the operation mode controller 5 switches the operation mode to the rescue operation mode before returning the operation mode to the normal operation mode. As a result of this switching, the door open/close controller 8 causes the elevator to open the doors for a given time on the emergency landing entrance floor. And at this time, the hall indication/informing controller 12 causes the hall indication/informing device provided on the hall of the emergency landing entrance floor, for which the door open/close controller 8 causes the doors to be opened for a given time, to indicate and provide information to the effect that the elevator can be used because of the return to the normal operation mode.

Furthermore, at the same time with this, the operation mode controller 5 automatically re-registers the car calls stored by the car call storage device 9. As a result of this, when the elevator closes its doors after the boarding of a user thereon, the elevator automatically runs to the registered floor (the initial designation floor of the user).

Next, the operation of the elevator controller will be described in more detail with the aid of FIG. 2.

Figure 2:
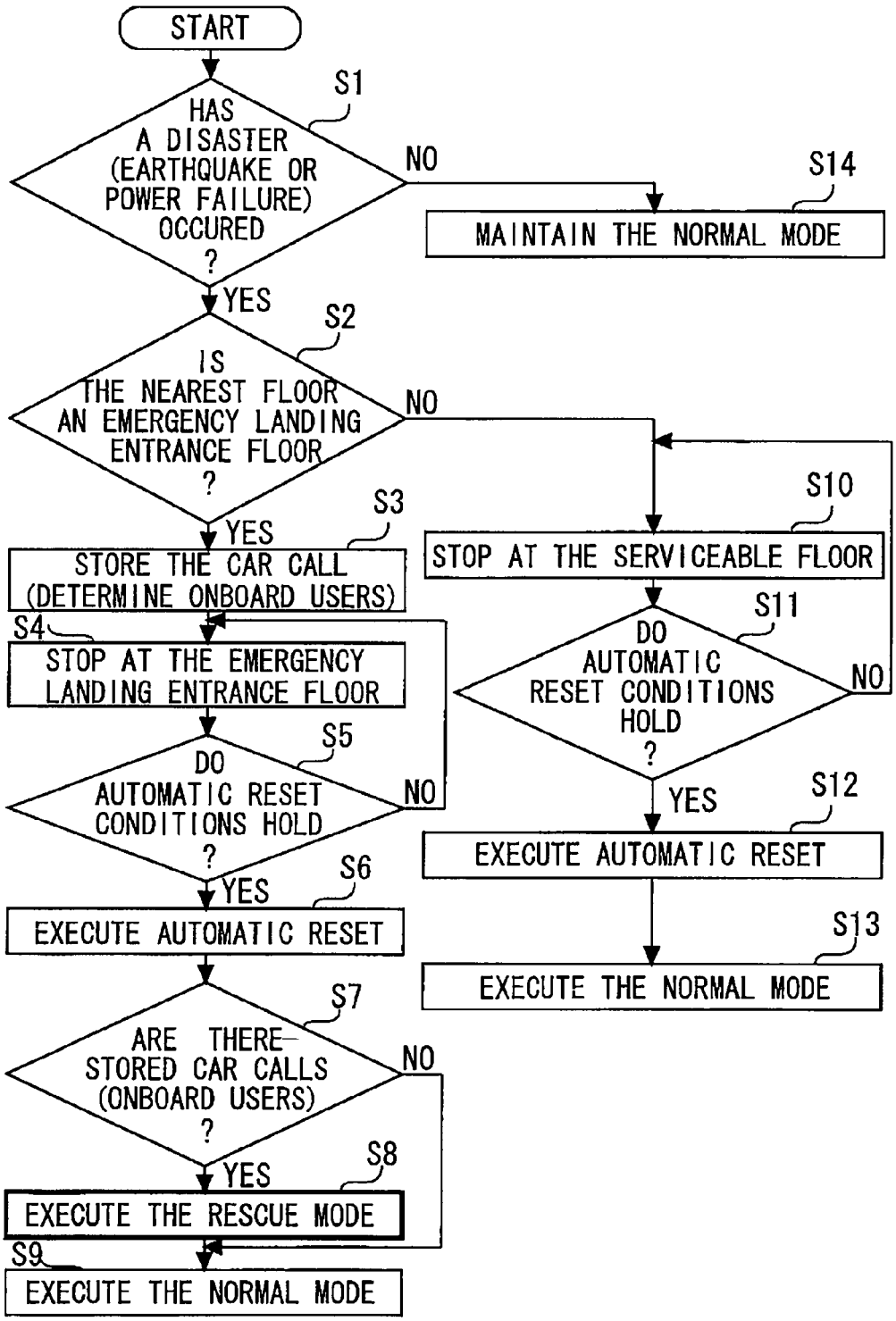
FIG. 2 is a flowchart to explain the operation of the elevator controller in Embodiment 1 of the present invention.

FIG. 2 is a flowchart to explain the operation of the elevator controller in Embodiment 1 of the present invention.

First, in Step S1, a determination is made as to whether or not a disaster has occurred. In the case where a disaster has occurred, the flow of actions proceeds to Step S2. In Step S2, a determination is made as to whether or not the nearest floor is an emergency landing entrance floor.

And in the case where the nearest floor is an emergency landing entrance floor, the flow of actions proceeds to Step S3. In Step S3, the car calls which have been registered till that point in time are stored. Also, on the basis of the existence or nonexistence of car calls a determination is made as to whether or not users are onboard in the car. That is, when car calls have been registered, it is determined that users are onboard in the car. On the other hand, when no car call has been registered, it is determined that no user is onboard in the car. After this determination, the flow of actions proceeds to Step S4. In Step S4, the car stops at the emergency landing entrance floor selected as the nearest floor, and the flow of actions proceeds to Step S5.

In Step S5, a determination is made as to whether or not automatic reset conditions for disaster detection hold. And when automatic reset conditions for disaster detection do not hold, in Step S4, the standstill condition of the car is maintained. On the other hand, when automatic reset conditions for disaster detection hold, the flow of actions proceeds to Step S6. In Step S6, automatic reset of disaster detection is executed, and the flow of actions proceeds to Step S7. In Step S7, a determination is made as to whether or not there are stored car calls.

And when there are stored car calls, the flow of actions proceeds to Step S8. In Step S8, the elevator operation mode becomes the rescue operation mode for rescuing the users who have escaped to the emergency landing entrance floor. And when the rescue operation mode is finished, the flow of actions proceeds to Step S9, and the elevator operation mode becomes the normal operation mode. On the other hand, when in Step S7 there is no stored car call, the elevator operation mode does not become the rescue operation mode of Step S8, and the flow of actions proceeds to Step S9, where the flow of actions proceeds to Step S9 and the elevator operation mode becomes the normal operation mode.

In contrast to the above-described actions, when in Step S2 the nearest floor is not an emergency landing entrance floor, the flow of actions proceeds to Step S10. In Step S10, the car comes to a standstill on a serviceable floor in the normal operation mode, and the flow of actions proceeds to Step S11. In Step S11, a determination is made as to whether or not automatic reset conditions for disaster detection hold. When automatic reset conditions for disaster detection do not hold, in Step S10, the standstill condition of the car is maintained.

On the other hand, when automatic reset conditions for disaster detection hold, the flow of actions proceeds to Step S12. In Step S12, automatic reset of disaster detection is executed, and the flow of actions proceeds to Step S13. In Step S13, the elevator operation mode becomes the normal operation mode. Incidentally, when in Step S1 no disaster has occurred, the flow of actions proceeds to Step S14, and the normal operation mode is maintained.

Next, the rescue operation mode of FIG. 2 will be described in detail with the aid of FIG. 3.

Figure 3:
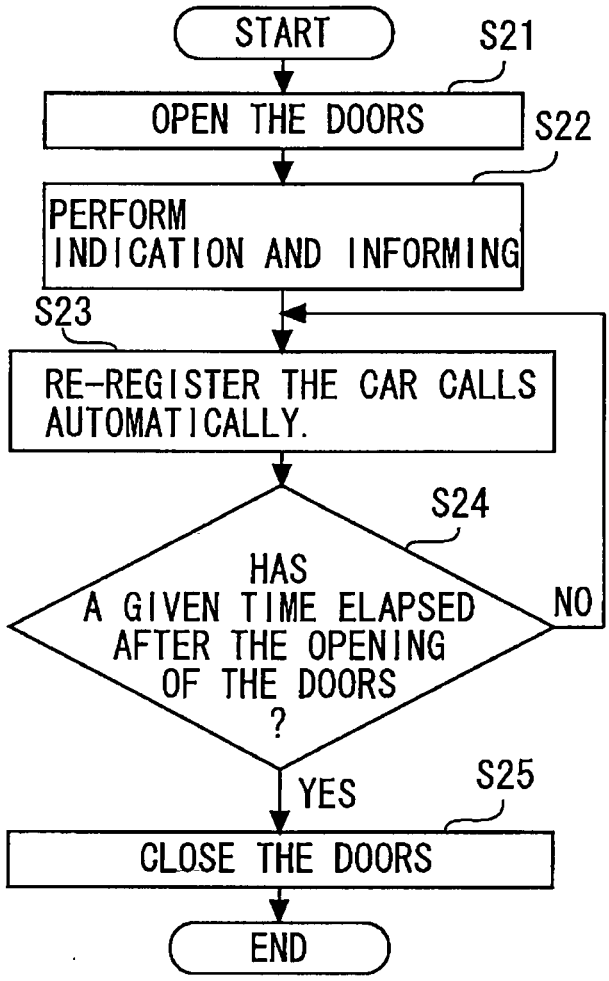
FIG. 3 is a flowchart to explain the rescue operation mode carried out by the elevator controller in Embodiment 1 of the present invention.

FIG. 3 is a flowchart to explain the rescue operation mode carried out by the elevator controller in Embodiment 1 of the present invention.

First, when the elevator operation mode has become the rescue operation mode, in Step S21, the door opening action of the elevator is performed on the emergency landing entrance floor to which users have escaped, and the flow of actions proceeds to Step S22. In Step S22, the hall indication/informing device provided in the hall 11 of the emergency landing entrance floor to which users have escaped, performs indication and informing to the users by means of indicators and announcement to the effect that the elevator can be used because of the return to the normal operation mode, thereby urging the users to board the car, and the flow of actions proceeds to Step S23.

In Step S23, the car calls stored in the car call storage device 9 are automatically re-registered, and the flow of actions proceeds to Step S24. In Step S24, a determination is made as to whether or not a given time has elapsed after the opening of the doors of the elevator. In the case where a given time has not elapsed after the opening of the doors of the elevator, in Step S24 the open condition of the doors of the elevator is maintained. On the other hand, in the case where a given time has elapsed after the opening of the doors of the elevator, the flow of actions proceeds to Step S25. In Step S25, the doors of the elevator are closed and the rescue operation mode is finished. And when the rescue operation mode is finished, as shown in FIG. 2, the normal operation mode is started.

Next, a concrete example of a series of actions of Embodiment 1 will be described with the aid of FIGS. 4 to 7.

Figure 4:
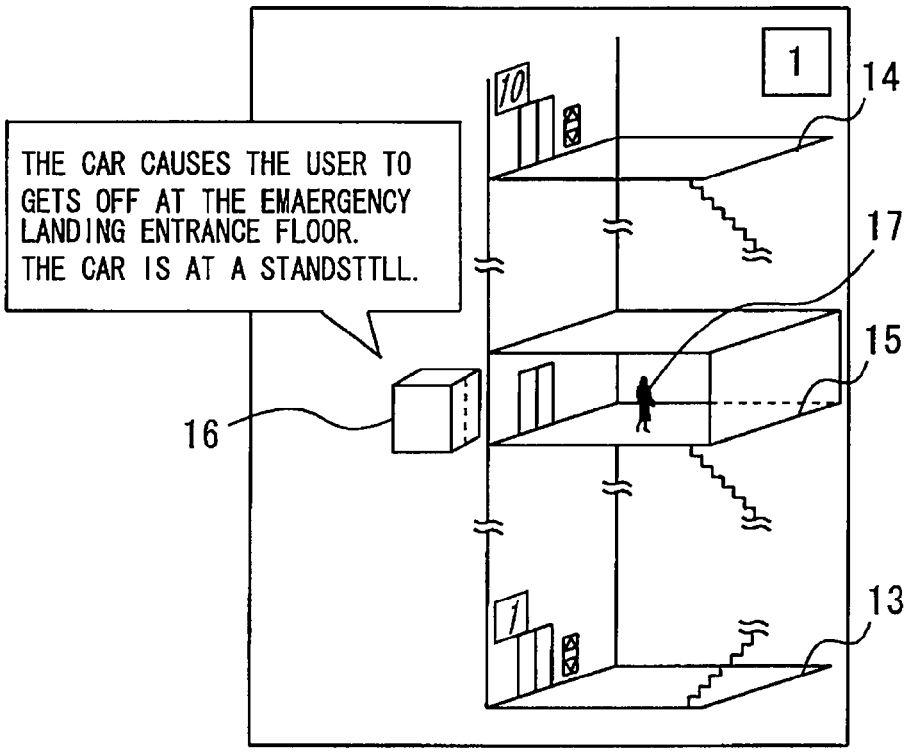
FIG. 4 is a diagram showing the condition of a car of an elevator, in which the elevator controller in Embodiment 1 of the present invention is used, the elevator being at a standstill at an emergency landing entrance floor.
Figure 5:
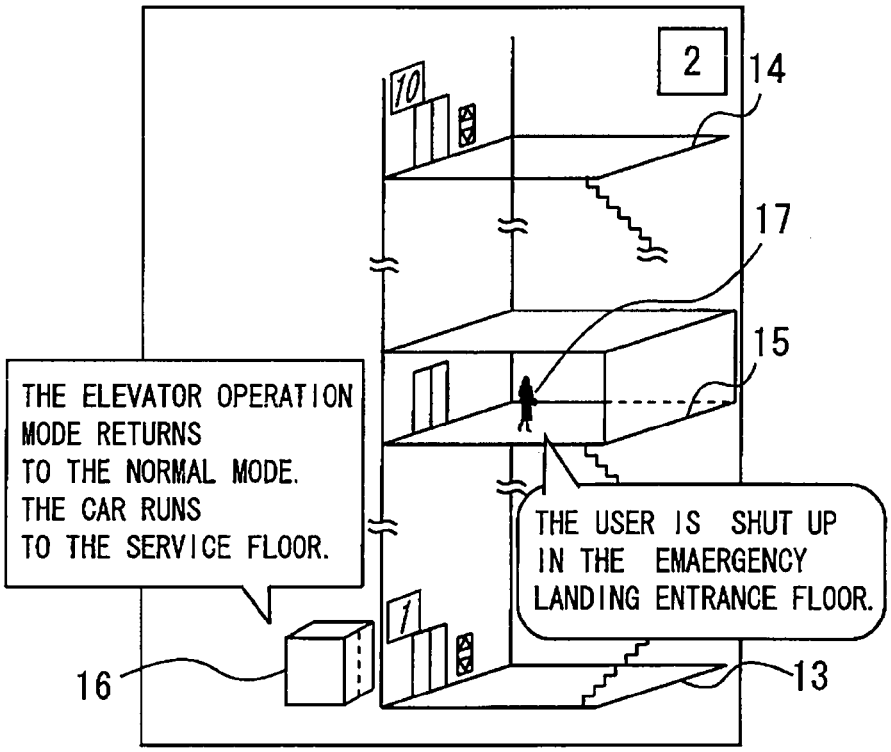
FIG. 5 is a diagram showing the condition of a user of the elevator, in which the elevator controller in Embodiment 1 of the present invention is used, who is shut up in the emergency landing entrance floor.

FIG. 4 is a diagram showing the condition of a car of an elevator, in which the elevator controller in Embodiment 1 of the present invention is used, the elevator being at a standstill at an emergency landing entrance floor. FIG. 5 is a diagram showing the condition of a user of the elevator, in which the elevator controller in Embodiment 1 of the present invention is used, who is shut up in the emergency landing entrance floor.

Figure 6:
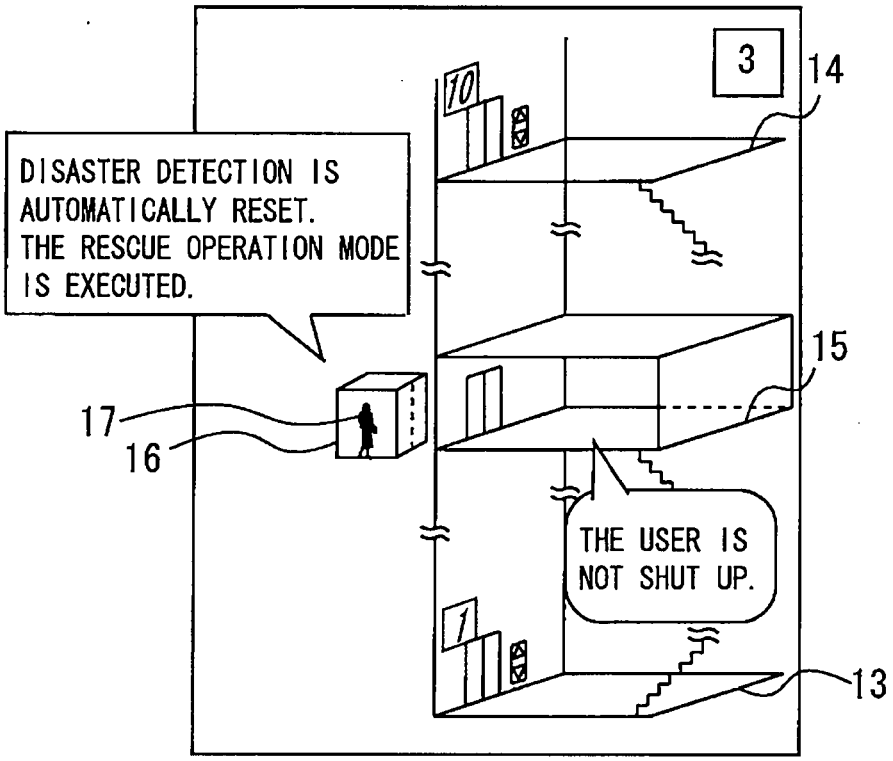
FIG. 6 is a diagram showing the condition of the user of the elevator, in which the elevator controller in Embodiment 1 of the present invention is used, during rescue from the emergency landing entrance floor.
Figure 7:
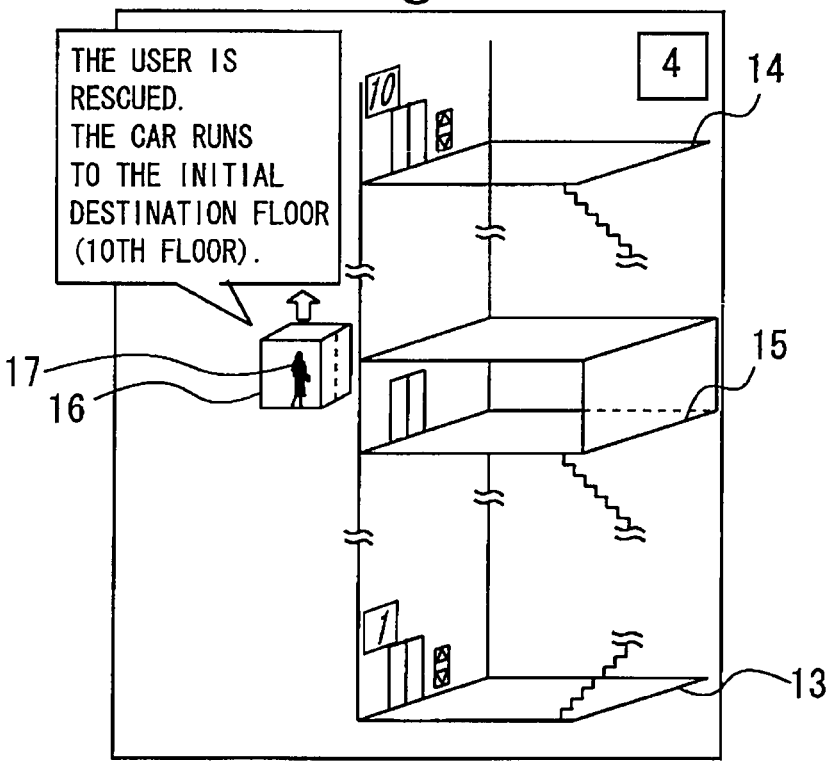
FIG. 7 is a diagram showing the condition of the user shut up in the emergency landing entrance floor of the elevator, in which the elevator controller in Embodiment 1 of the present invention is used, during movement to his or her initial destination floor.

FIG. 6 is a diagram showing the condition of the user of the elevator, in which the elevator controller in Embodiment 1 of the present invention is used, during rescue from the emergency landing entrance floor. FIG. 7 is a diagram showing the condition of the user shut up in the emergency landing entrance floor of the elevator, in which the elevator controller in Embodiment 1 of the present invention is used, during movement to his or her initial destination floor.

In FIG. 4, reference numeral 13 denotes the first floor of a building. This first floor 13 is a service floor of the normal operation mode. Reference numeral 14 denotes the 10th floor. Also this 10th floor 14 is a service floor of the normal operation mode. Reference numeral 15 denotes an emergency landing entrance floor. This emergency landing entrance floor 15 is provided between the first floor 13 and the 10th floor 14. This emergency landing entrance floor 15 is not a service floor of the normal operation mode.

In this connection, suppose the case where a user 17 who has boarded a car 16 at the first floor 13 has registered a car call for the 10th floor 14 which is a destination floor. In this case, the car 16 with the user 17 onboard runs toward the 10th floor 14. At this time, if a disaster occurs when the car 16 is running short of the emergency landing entrance floor 15, the car 16 stops at the emergency landing entrance floor 15 which is the nearest floor.

As a result of this, the user 17 can escape to the emergency landing entrance floor 15. However, in the case where the disaster comes to an end, disaster detection is automatically reset and the elevator operation mode returns to the normal operation mode instead of becoming the rescue operation mode, as shown in FIG. 5, the car 16 runs to the service floor of the normal operation mode. As a result of this, the user 17 becomes shut up in the emergency landing entrance floor 15.

On the other hand, in this embodiment, as shown in FIG. 6, the user 17 who has been shut up in the emergency landing entrance floor 15 is rescued by the rescue operation mode. Furthermore, in this embodiment, as shown in FIG. 7, car calls registered at the time of disaster detection are automatically re-registered. Consequently, the car 16 runs from the emergency landing entrance floor 15 to the 10th floor which is the initial destination floor.

According to Embodiment 1 described above, when the operation mode controller 5 has returned the operation mode from the emergency operation mode to the normal operation mode, the door open/close controller 8 causes the elevator to open its doors for a given time at the nearest emergency landing entrance floor. And, when the operation mode controller 5 has returned the operation mode from the emergency operation mode to the normal operation mode, the hall indication/informing controller 12 informs an informing device, which is provided in the hall 11 of the emergency landing entrance floor 15 for which the door open/close controller 8 causes the doors to be opened for a given time, to the effect that the elevator can be used.

Consequently, it is possible to stop at the nearest floor is made in the event of a disaster and to prevent the user 17 from becoming shut up in emergency landing entrance floor 15 and from being left neglected. And it is unnecessary to provide a special floor to which even wheelchair users can be evacuated and guided, and it is possible to apply the elevator controller to an elevator installed in an existing building.

When the operation mode returns from the emergency operation mode to the normal operation mode, the operation mode controller 5 registers car calls corresponding to the car calls stored in the car call storage device 9. Therefore, the user 17 who has escaped to the emergency landing entrance floor 15 can go to the initial destination floor using the elevator without performing a registration operation again.

Furthermore, in the case where car calls had already been registered in the car call storage device 9 when the disaster detection device 2 has detected a disaster, the operation mode controller 5 switches the operation mode from the normal operation mode to the emergency operation mode. On the other hand, in the case where no car call had been registered in the car call storage device 9 when the disaster detection device 2 has detected a disaster, the operation mode controller 5 maintains the operation mode at the normal operation mode. Consequently, it is possible to efficiently operate the elevator without performing an unnecessary rescue operation.

Incidentally, in Embodiment 1, the configuration is such that an indication/informing device provided in the hall 11 of the emergency landing entrance floor 15, for which the door open/close controller 8 causes the doors to be opened for a given time, is caused to provide information to the effect that the elevator can be used. However, the configuration may be such that an indication/informing device in the car is caused to provide information to the effect that the elevator can be used.

INDUSTRIAL APPLICABILITY

As described above, the elevator controller of the present invention can be applied to an elevator which achieves an early stop at the nearest floor.

DESCRIPTION OF SYMBOLS

1 disaster sensing device,
2 disaster detection device,
3 reset determination device,
4 car control panel,
5 operation mode controller,
6 nearest floor determination device,
7 run/stop controller,
8 door open/close controller,
9 car call storage device,
10 car indication/informing controller,
11 hall,
12 hall indication/informing controller,
13 first floor,
14 10th floor,
15 emergency landing entrance floor,
16 car,
17 user.

The invention claimed is:

1. An elevator controller comprising:

an operation mode controller which, upon detection of a disaster by a disaster detection device, switches an operation mode of an elevator from a normal operation mode to an emergency operation mode which involves evacuating a user in a car of the elevator by stopping the car at the nearest emergency landing entrance floor other than service floors of the normal operation mode and, upon reset of the disaster detection device, returns the operation mode to the normal operation mode;

a door open/close controller which causes the elevator to open the elevator door at the nearest emergency landing entrance floor for a given time when the operation mode controller has returned the operation mode from the emergency operation mode to the normal operation mode; and an informing controller which causes an informing device, which is provided in a hall of an emergency landing entrance floor for which-the door open/close controller causes the door to be opened for a given time or provided in the car, to provide information to the effect that the elevator can be used when the operation mode controller has returned the operation mode from the emergency operation mode to the normal operation mode.

2. The elevator controller according to claim 1, further comprising:

a storage device which stores car calls already registered when the disaster detection device has detected a disaster, wherein the operation mode controller registers car calls corresponding to the car calls stored in the storage device when the operation mode controller has returned the operation mode from the emergency operation mode to the normal operation mode.

3. The elevator controller according to claim 1, wherein the operation mode controller switches the operation mode from the normal operation mode to the emergency operation mode in the case where car calls had already been registered when the disaster detection device has detected a disaster, and maintains the operation mode at the normal operation mode in the case where no car call had been registered when the disaster detection device has detected a disaster.

4. The elevator controller according to claim 2, wherein the operation mode controller switches the operation mode from the normal operation mode to the emergency operation mode in the case where car calls had already been registered when the disaster detection device has detected a disaster, and maintains the operation mode at the normal operation mode in the case where no car call had been registered when the disaster detection device has detected a disaster.

* * * * *